US006703572B1

(12) United States Patent
Broghammer

(10) Patent No.: US 6,703,572 B1
(45) Date of Patent: Mar. 9, 2004

(54) ANTI-TWIST INSERT FOR CIRCUIT BREAKER HANDLER ACCESSORY

(75) Inventor: William J. Broghammer, Cedar Rapids, IA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 10/280,337

(22) Filed: Oct. 25, 2002

(51) Int. Cl.[7] ..... H01H 9/28

(52) U.S. Cl. ..... 200/43.14; 200/43.11; 200/43.15; 200/43.19; 200/43.21

(58) Field of Search ..... 200/43.01, 43.11, 200/43.14–43.16, 43.19, 43.21, 43.22, 334, 50.01, 318, 321, 322

(56) References Cited

U.S. PATENT DOCUMENTS 4,897,515 A * 1/1990 Zubar et al. ..... 200/43.14
5,060,107 A * 10/1991 Castonguay ..... 361/115
5,500,495 A * 3/1996 Benda et al. ..... 200/43.14
6,015,956 A * 1/2000 Green ..... 200/43.14
6,365,851 B1 * 4/2002 Gasper ..... 200/43.14
6,476,698 B1 * 11/2002 Anand et al. ..... 335/202

* cited by examiner

*Primary Examiner*—Michael Friedhofer
(74) *Attorney, Agent, or Firm*—Larry I. Golden

(57) ABSTRACT

A switch-lock assembly for securing a circuit breaker in one of a plurality of circuit breaker positions, comprising a switch-lock attachment and an anti-twist insert. The switch-lock attachment includes a spring member adapted to engage a retaining area of the circuit breaker, a support member adapted to accommodate the spring member, and a locking member connected with the support member via the spring member. The insert includes a securing end adapted to engage a first area of the circuit breaker for limiting the movement of the insert relative to the circuit breaker, and an interface area adapted to engage the switch-lock attachment for limiting the movement of the switch-lock attachment relative to the insert.

28 Claims, 9 Drawing Sheets

ANTI-TWIST INSERT FOR CIRCUIT BREAKER HANDLER ACCESSORY

FIELD OF THE INVENTION

This invention is directed generally to electromechanical devices and, more specifically, to an anti-twist insert for use in a switch-lock assembly of a circuit breaker.

BACKGROUND OF THE INVENTION

Electrical devices, such as circuit breakers, are used in many residential, commercial, and industrial electric systems, being indispensable components of such systems in protecting against over-current conditions. A circuit breaker includes a switch that can be placed in at least two positions: an ON position and an OFF position. In the ON position the circuit breaker closes an electrical circuit, thus allowing the flow of current in the particular circuit. In the OFF position the circuit breaker opens the electrical circuit, thus interrupting the flow of current in the particular circuit.

Under certain circumstances, it is desirable to lock the switch in either the ON position or the OFF position. For example, if a person is servicing components of an electrical circuit it is highly desirable to ensure that the circuit breaker remains in the OFF position. Serious bodily injury, even death, may result if the circuit breaker is accidentally turned ON while the person is in contact with components of the electrical circuit. Similarly, to prevent trespassers from tampering with an electrical circuit, it may be desirable to lock a circuit breaker in the ON position. This would ensure that only an authorized person may manually interrupt the flow of current.

Although some switch-locking devices for circuit breakers are available, they are in general expensive, complex, or flimsy. For example, a switch-locking device comprises a support part, a locking part, and a spring clip. The spring clip has a middle section that is fixed in the locking part, two legs that are slidably-engaged in two slots of the support part, and two ends that are inserted into two holes of a circuit breaker. After the locking part is swung in a counterclockwise direction to fit over the support part, the circuit breaker can be locked by inserting a padlock into a ring of the support part. Although such a switch-locking device provides adequate support when subjected to a tensile force, i.e., when the device is being pulled, it is nevertheless too flimsy when it is subjected to compressive or rotational forces, i.e., when the device is being pushed or twisted. The weak protection that the device provides when being pushed or twisted is due in great part to the fact that the support comes only from the two legs of the spring clip. For example, the switch-locking device can be separated from the circuit breaker when it encounters a relatively low twisting force because the two legs are easily displaced from their respective holes. Regardless of whether the twisting motion is accidental or intentional, the twisting motion renders the switch-locking device highly unreliable.

Accordingly, there is a need for a simple component that would prevent the easy removal of the switch-locking device when a twisting force is applied. There is also a need for a simple component that would provide greater support when a compressive force is applied to the switch-locking device.

SUMMARY OF THE INVENTION

Briefly, in accordance with the foregoing, a switch-lock assembly, for securing a circuit breaker in one of a plurality of circuit breaker positions, includes a switch-lock attachment and an anti-twist insert. The switch-lock attachment includes a spring member adapted to engage a retaining area of the circuit breaker, a support member adapted to accommodate the spring member, and a locking member connected with the support member via the spring member. The insert includes a securing end adapted to engage a first area of the circuit breaker for limiting the movement of the insert relative to the circuit breaker, and an interface area adapted to engage the switch-lock attachment for limiting the movement of the switch-lock attachment relative to the insert.

DETAILED DESCRIPTION OF THE ILLUSTRATED EMBODIMENT

Figure 1:
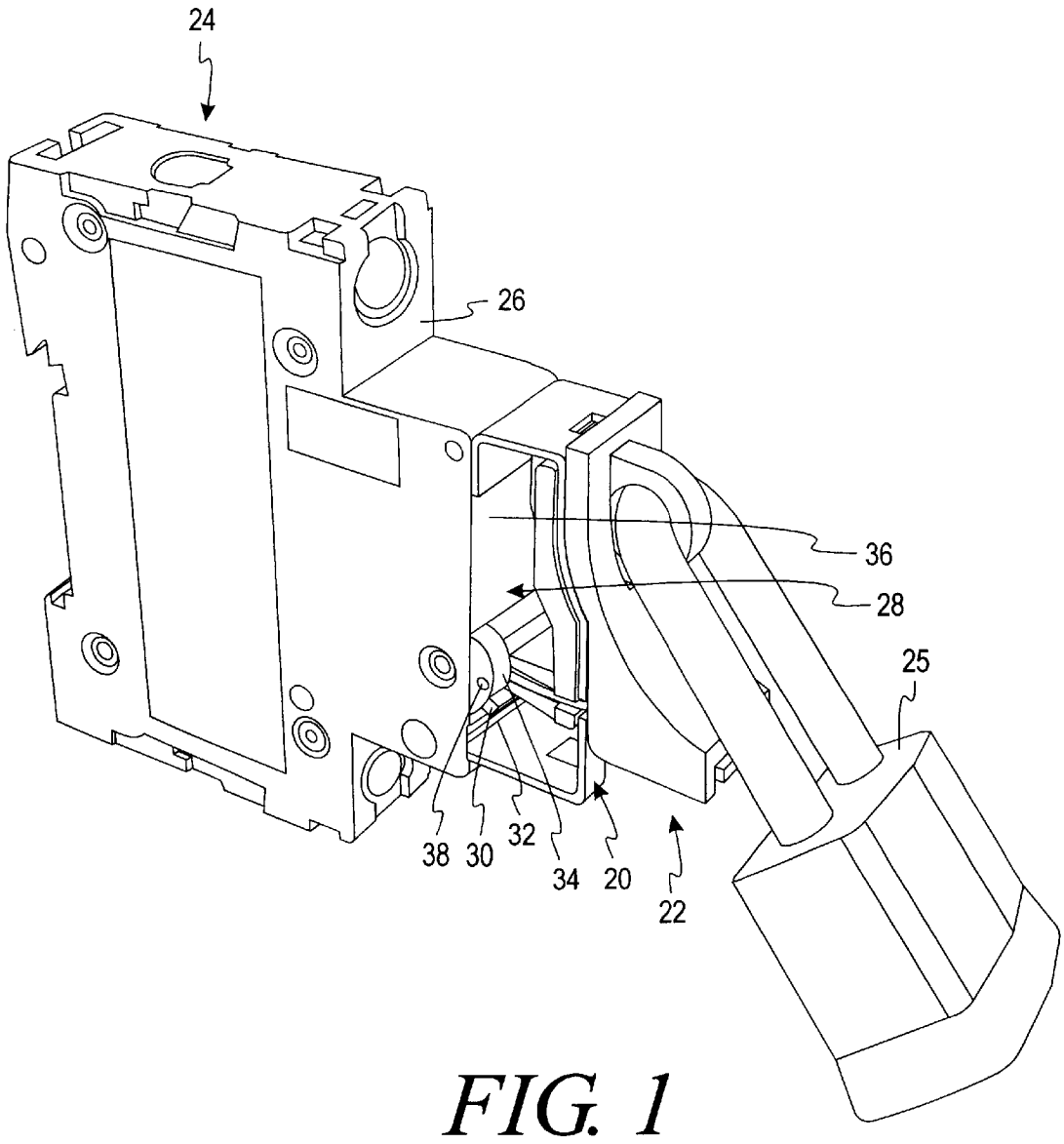
FIG. 1 is a perspective diagrammatic of a circuit breaker embodying the present invention.

Referring now to the drawings, and initially to FIG. 1, an anti-twist insert 20 and a switch-lock attachment 22, in one embodiment of the invention, are mounted on a circuit breaker 24. The switch-lock attachment 22 is shown in a secured position, and a padlock 25 is used to lock the switch-lock attachment 22 and the insert 20 to the circuit breaker 24. The insert 20 and the switch-lock attachment 22 will be described in more detail below.

The circuit breaker 24 includes a casing 26 and a switch area 28. The casing 26 is made of two similar parts, a cover and a base, wherein the base is adapted to hold most of the internal components of the circuit breaker 24. In general, after the internal components of the circuit breaker 24 are installed on the base, the circuit breaker 24 is enclosed by positioning and securing the cover on top of the base.

The switch area 28 is rectangularly shaped, and it includes a switch 30, a securing slot 32, a retaining area 34, and a resting area 36. The switch 30 can be used to manually move the circuit breaker 24 between a plurality of circuit breaker positions. For example, an operator can move the switch 30 between an ON position and an OFF position. In the ON position, the circuit breaker 24 is adapted to allow the flow of current through a particular electrical circuit, while in the OFF position the circuit breaker 24 is adapted to interrupt the flow of current through the particular electrical circuit. The switch 30 can also be used to indicate the position of the circuit breaker 24. For example, an operator would want to confirm that the circuit breaker 24 is in the OFF position before commencing human interaction with the internal components of the circuit breaker 24 or with an electrical circuit connected to the circuit breaker 24, such as when routine maintenance is required.

The securing slot 32 is located on one end of the switch area 28, near the switch 30, and it protrudes a short distance into the casing 26. The retaining area 34 is located next to the switch 30, and it includes two symmetrically-opposed retaining holes 38. The resting area 36 is located opposite the securing slot 32, and is generally a flat surface.

Figure 2:
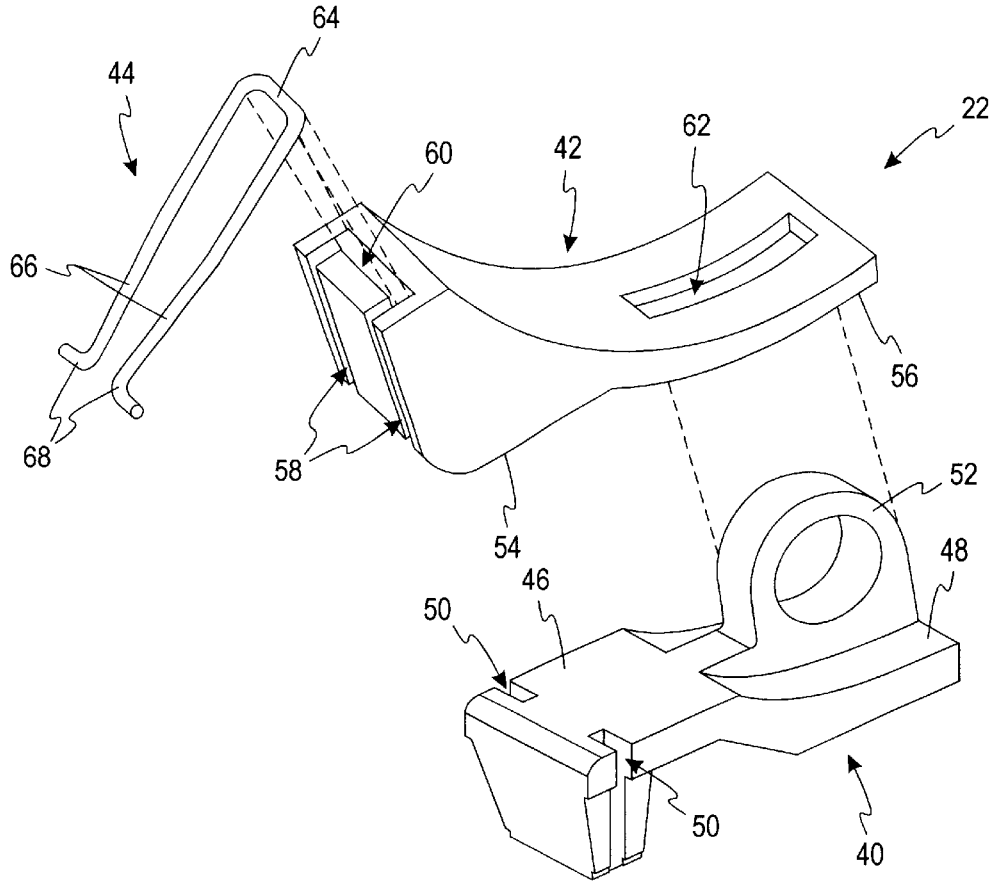
FIG. 2 is an exploded diagrammatic of a switch-lock attachment comprising a support part, a locking part, and a spring clip.

Referring now to FIG. 2, one embodiment of the switch-lock attachment 22 will be described in more detail. The switch-lock attachment 22 includes a support member 40, a locking member 42, and a spring member 44. The support member 40 includes a flat mating surface 46, a curved mating surface 48 located next to the flat mating surface 46, a pair of channels 50 located on one end of the flat mating surface 46, and a ring 52 centrally located on the curved mating surface 48 and protruding from the curved mating surface 48. The channels 50 are formed along the entire thickness of the support member 40, as shown.

The locking member 42 includes a primary mating surface 54 and a secondary mating surface 56, wherein the primary mating surface 54 is adapted to match the flat mating surface 46 and the secondary mating surface 56 is adapted to match the curved mating surface 48. The locking member 42 also includes a pair of parallel openings 58 and a retaining opening 60. The parallel openings 58 protrude through the entire thickness of the locking member 42, and the retaining opening 60 is positioned perpendicular to the parallel openings 58 for connecting the parallel openings 58 at one end. A ring slot 62 is positioned on the secondary mating surface 56, and the ring slot 62 is formed through the entire thickness of the locking member 42.

The spring member 44 includes a middle section 64 connecting a pair of legs 66 to each other, each one of the legs 66 having a retaining end 68. To connect the spring member 44 to the locking member 42, the middle section 64 is inserted into the retaining opening 60 and each of the legs 66 is inserted into respective ones of the parallel openings 58. To connect the spring member 44 and the locking member 42 to the support member 40, each of the legs 66 is inserted through respective ones of the channels 50 wherein each retaining end 68 depends beyond channels 50 of the support member 40.

When the switch-lock attachment 22 is assembled, the locking member 42 is adapted to move between a secured position and an open position. In the secured position, the primary mating surface 54 is in contact with the flat mating surface 46 and the secondary mating surface 56 is in contact with the curved mating surface 48. Also, the ring 52 protrudes through the ring slot 62. In the open position the locking member 42 pivots around the middle section 64, rotating in a counterclockwise direction around the axis of the middle section 64, eventually causing each one of the legs 66 to separate from the respective ones of the parallel openings 58. As the locking member rotates in the counterclockwise direction, the ring slot 62 disengages away from the ring 52.

Figure 3A:
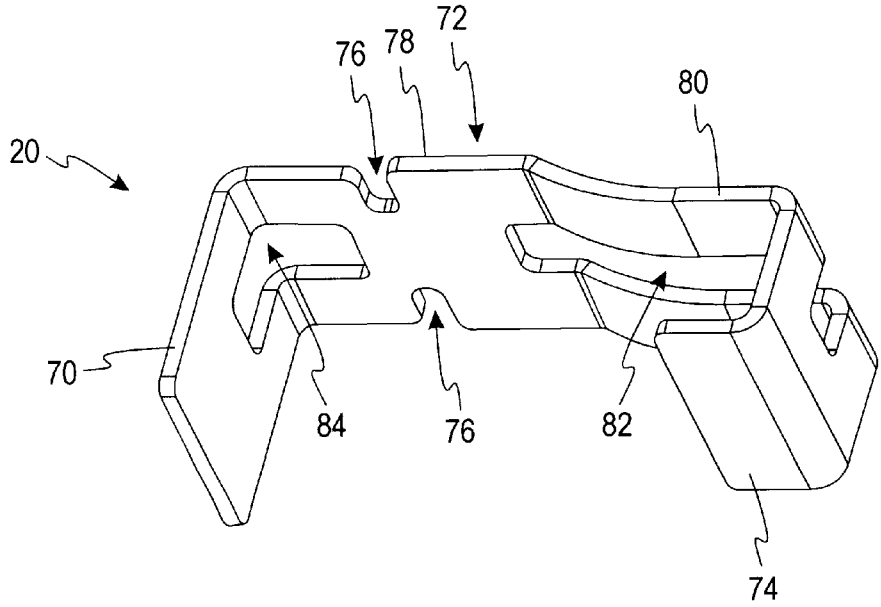
FIG. 3*a* is a perspective view of one embodiment of an insert.
Figure 3B:
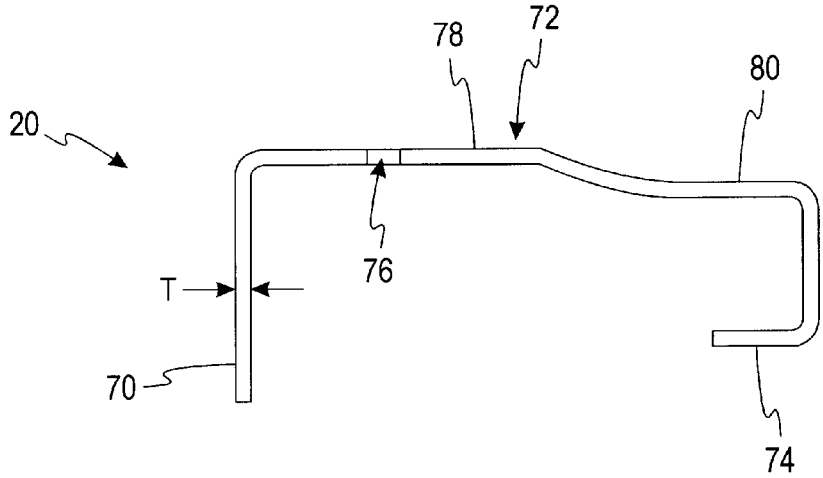
FIG. 3*b* is a planar view of the insert of FIG. 3*a*.

Referring now to FIGS. 3*a* and 3*b*, one embodiment of the anti-twist insert 20 will be described in more detail. The insert 20 includes a securing end 70, an interface area 72, and a supporting end 74. The securing end 70 has a generally rectangular shape and is adapted to fit in the securing slot 32 of the circuit breaker 24. The interface area 72 includes a plurality of notches 76, a first mating surface 78, and a second mating surface 80. The notches 76 are located along the first mating surface 78, are symmetrically located with respect to each other, and are adapted to match the channels 50 of the support member 40. The first mating surface 78 is adapted to match the flat mating surface 46 of the support member 40 and the primary mating surface 54 of the locking member 42. The second mating surface 80 is adapted to match the curved mating surface 46 of the support member 40 and the secondary mating surface 54 of the locking member 42. The second mating surface 80 includes a ring aperture 82 adapted to match the ring slot 62.

In another embodiment, the insert 20 includes an observation opening 84 located between the securing end 70 and the interface area 72. The observation opening 84 is adapted to allow an operator to visually inspect the position of the circuit breaker 24. This is particularly useful when a plurality of circuit breakers 24 are installed next to each other, in a parallel configuration, because, otherwise, the switch 30 would be obstructed from plain view. The observation opening 84 allows the operator to do a cursory visual inspection of each switch to determine, for example, whether a particular circuit breaker 24 is ON or OFF.

In one embodiment of the present invention, the insert 20 is composed of a semi-rigid material. The material can be a metal or a plastic, e.g., a commercially available steel.

Figure 4:
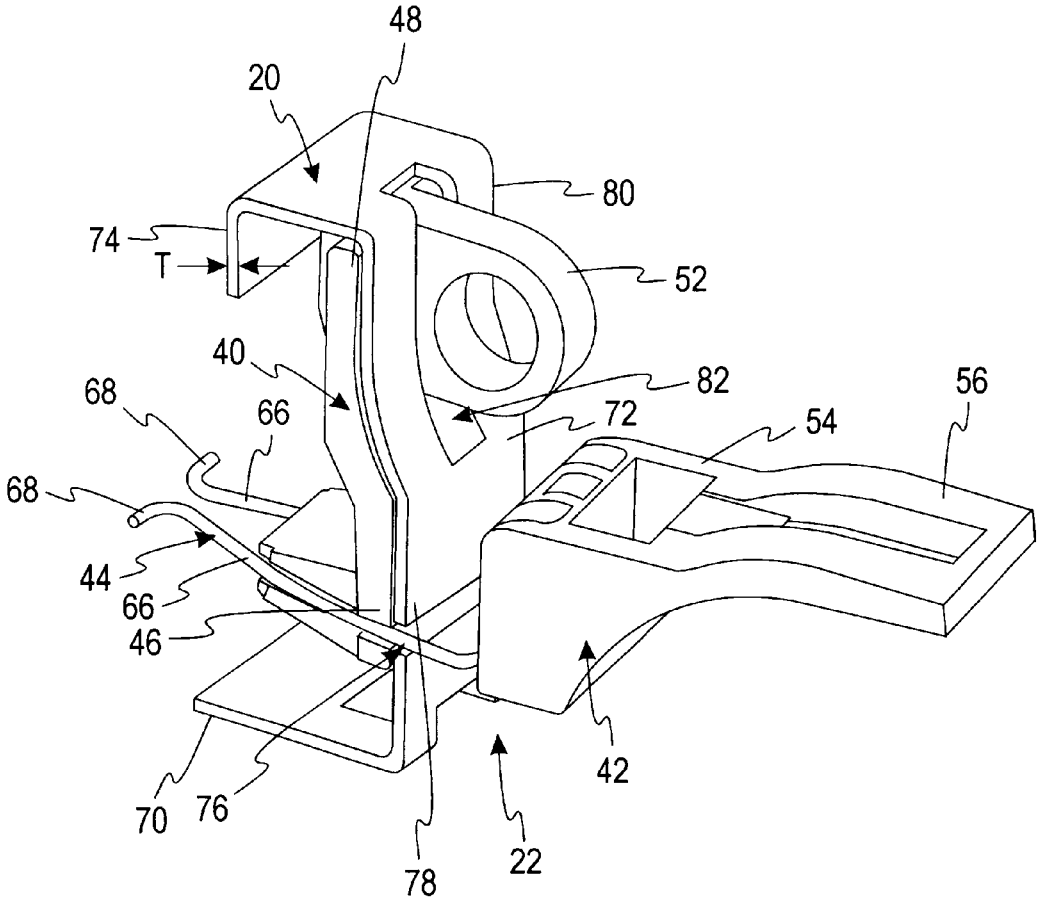
FIG. 4 is a perspective diagrammatic of an assembled embodiment of the present invention.
Figure 5:
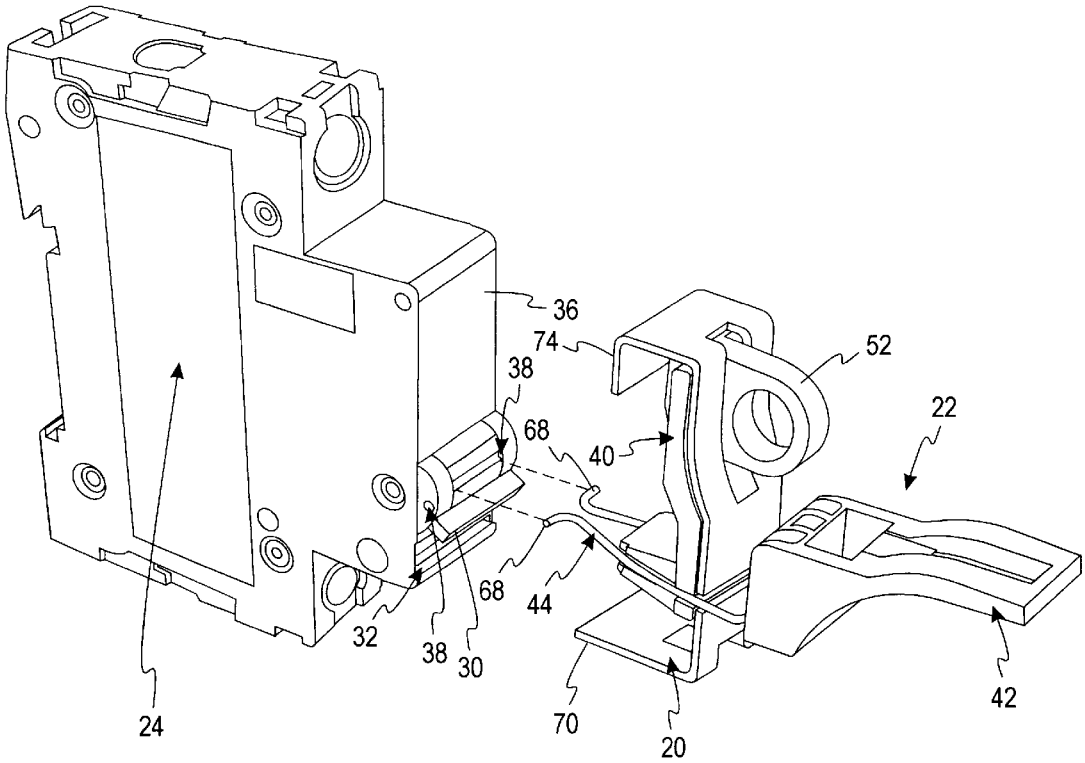
FIG. 5 is a perspective diagrammatic of the embodiment of FIG. 4 shown before the spring clip is connected to a circuit breaker.
Figure 6:
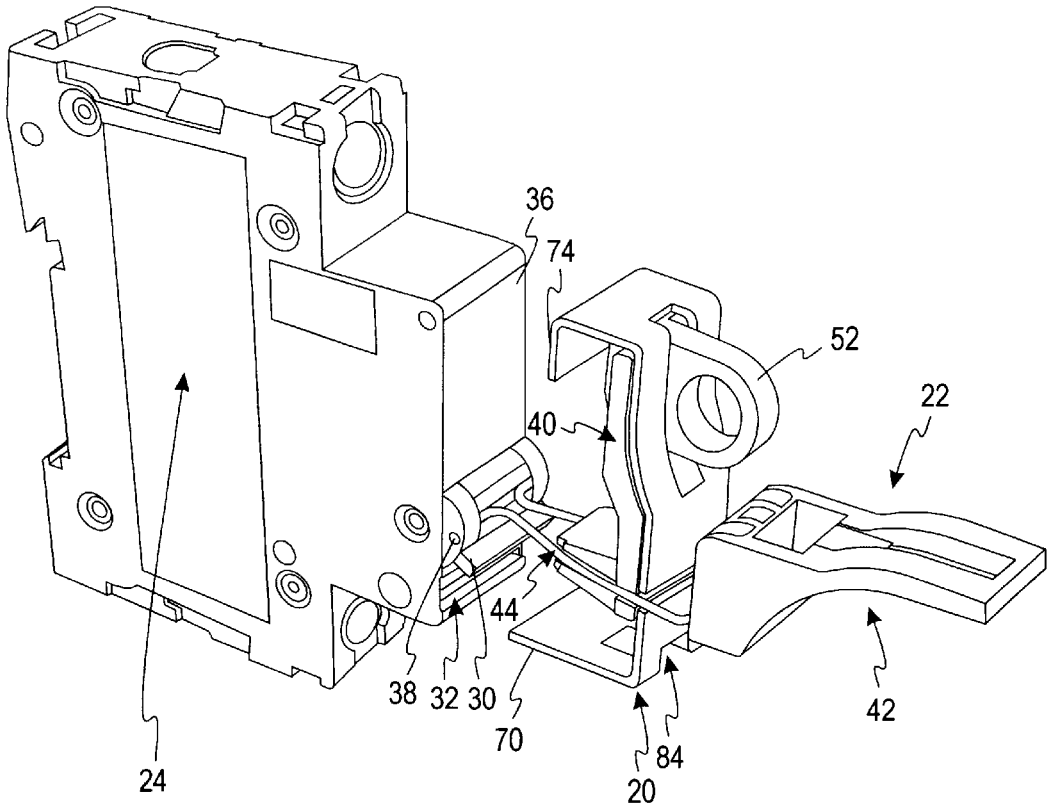
FIG. 6 is a perspective diagrammatic of the embodiment of FIG. 4 shown after the spring clip is connected to the circuit breaker and before an insert is inserted into the circuit breaker.
Figure 7:
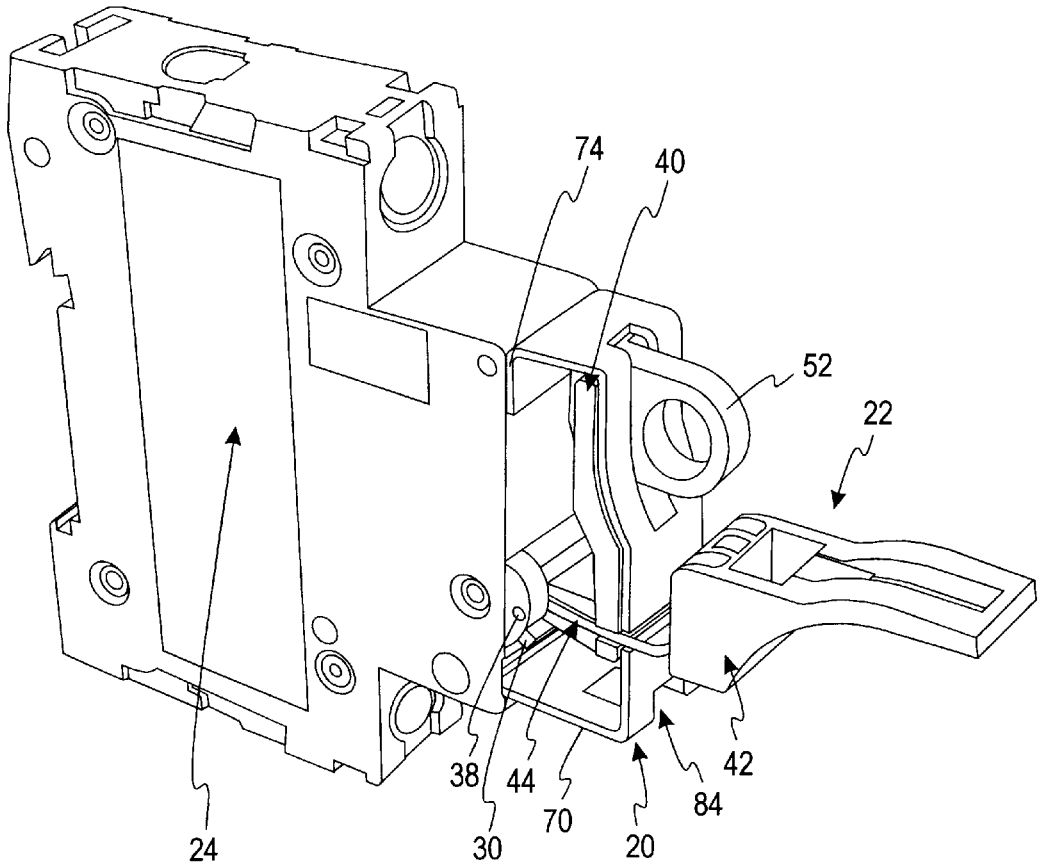
FIG. 7 is a perspective diagrammatic of the embodiment of FIG. 4 shown after the insert is inserted into the circuit breaker and before the locking part is placed in a locked position.
Figure 8:
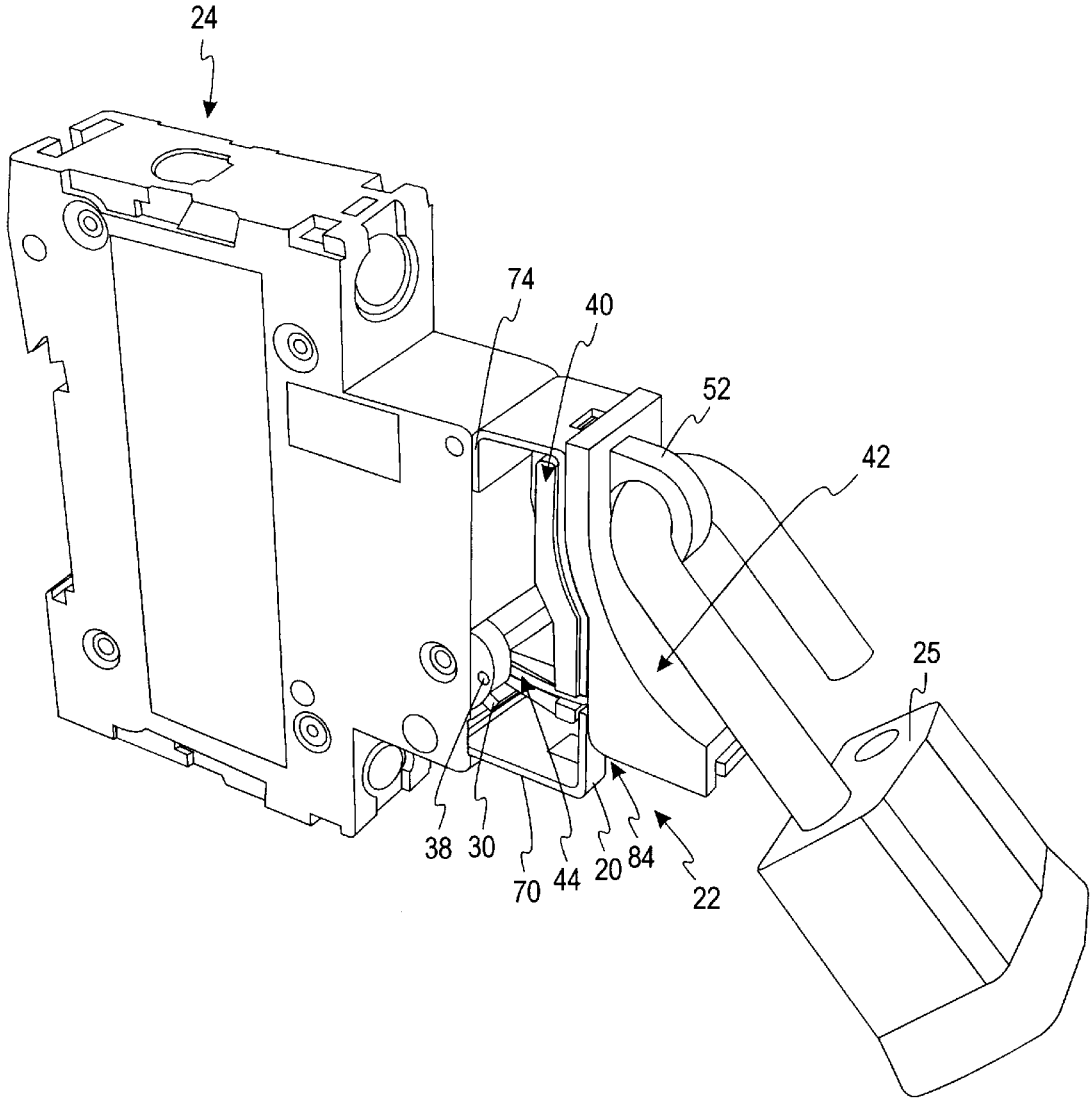
FIG. 8 is a perspective diagrammatic of the embodiment of FIG. 4 shown after the locking part is placed in a locked position and before the circuit breaker is secured with a padlock.

Referring now to FIG. 4, the assembly of the insert 20 and the switch-lock attachment 22, in one embodiment of the present invention, will be described in more detail. The insert 20 is positioned over the support member 40 such that the ring 52 protrudes through the ring aperture 82, the first mating surface 78 contacts the flat mating surface 46, the second mating surface 80 contacts the curved mating surface 48, and each one of the notches 76 is aligned with one of the channels 50.

Each one of the legs 66 is inserted through one of the notches 76 such that the spring member 44 holds the insert 20 between the locking member 42 and the support member 40 of the switch-lock attachment 22. When the locking member 42 is in the secured position, the separation distance between the support member 40 and the locking member 42 is generally equal to a thickness T of the insert 20, i.e., the separation distance is minimal. The connection between the notches 76 and the spring member 44, via each one of the legs 66, minimizes the lateral movement of the switch-lock attachment 22 relative to the insert 20. Similarly, the connection between the ring aperture 82 and the ring 52 minimizes the lateral movement between the switch-lock attachment 22 and the insert 20. The two connecting points, at the notches 76 and at the ring aperture 82, provide a bonding between the insert 20 and the switch-lock attachment 22 such that any generally rotational movement, including any lateral movement, between the insert 20 and the switch-lock attachment 22 is generally prevented. In other words, rotational and/or lateral movement of the switch-lock attachment 22 is inhibited by at least two connections when the insert 20 is installed. First, the ring 52 which protrudes through the ring aperture 82 opposes rotational or lateral movement of the switch-lock attachment 22. Second, the spring member 44 when received in the notches 76 also opposes rotational or lateral movement of the switch-lock attachment 22.

Referring now to FIGS. 5–8, the assembly of the insert 20 and the switch-lock attachment 22 to the circuit breaker 24 will be described. When the insert 20 is not installed, the only connection between the switch-lock attachment 22 and the circuit breaker 24 is provided by the two legs 66 of the spring member 44 which are retained by the two retaining holes 38. If the switch-lock attachment 22 is subjected to a relatively low twisting force, such as a rotational force around the axis of the legs 66, the switch-lock attachment 22 can easily snap out of place. For example, a twisting force can be applied accidentally when an operator is locking the switch-lock attachment 22 with a locking mechanism such as the padlock 25, resulting in the dislodgment of the switch-lock attachment 22 from the circuit breaker 24. This type of dislodgment is particularly likely to happen when a single, heavy padlock 25 is used to lock a plurality of switch-lock attachment 22. Note that the padlock 25 is only exemplary and other locking devices may be used, e.g., a "U" type lock, a chain-padlock combination, or a cable lock. The dislodgment of the switch-lock attachment 22 from the circuit breaker 24 can also occur when a plurality of padlocks 25 are used to lock a single switch-lock attachment 22 via a padlock accessory.

After assembling the insert 20 in-between the support member 40 and the locking member 42 and interlocking the insert 20 with the spring member 44, as described above, each retaining end 68 is squeezed towards the other such that the securing end 70 is aligned with the securing slot 32 and the supporting end 74 is aligned with the resting area 76. As the locking member 42 is moved to its open position, the switch-lock attachment 22 is urged towards the circuit breaker 24 causing each retaining end 68 to be received in each one of the retaining holes 38. After positioning the secured end 70 into the securing slot 32, the locking member 42 is moved to its secured position.

In the secured position, the spring member 44 holds the insert 20, the support member 40, the locking member 42, and the circuit breaker 24, in tension. The secured end 70 provides the anti-rotational support to prevent the accidental or intentional twisting of the switch-lock attachment 22 from the circuit breaker 24. The supporting end 74 provides the compression support to prevent the potential dislodgment of the switch-lock attachment 22 from the circuit breaker 24. In addition, the padlock 25 can be attached to the ring 52 to lock the switch-lock attachment 22 to the circuit breaker 24.

Adding the insert 20 to the switch-lock attachment 22 increases the force required to twist-off the switch-lock attachment 22 from the circuit breaker 24. Whereas before adding the insert 20 the only connection between the switch-lock attachment 22 and the circuit breaker 24 relied on the two legs 66, now, the switch-lock attachment 22 also relies on the securing end 70 of the insert 20 to limit any rotational or lateral movement of the switch-lock attachment 22 relative to the circuit breaker 24, and in particular the twisting motion around the axis of the legs 66. Furthermore, the supporting end 74 of the insert 20 adds extra support to the switch-lock attachment 22 and limits the displacement of the switch-lock attachment 22 when subjected to a compressive force, such as when the switch-lock attachment 22 is pushed towards the circuit breaker 24.

In another embodiment, a plurality of circuit breakers 24 are installed next to each other, each circuit breaker 24 having a switch-lock attachment 22 with an insert 20, and locking all the circuit breakers 24 to their respective switch-lock attachment 22 and insert 20 using a single padlock 25. Using a single padlock 25 for a plurality switch-lock attachments 22 enables an operator to monitor the operation of a multitude of circuit breakers 24 with the use of a single key. Also, where the position of a plurality of circuit breakers 24 must be made dependent on each other, it is easier to group the circuit breakers 24 into one single system that contains a single padlock 25. For example, it may be desirable to ensure that while a number of the plurality of circuit breakers 24 are in the ON position, another number of the plurality of circuit breakers 24 are in the OFF position. Using a single padlock 25, and therefore a single key, makes the monitoring of the plurality of circuit breakers 24 easy and efficient.

In another embodiment, a plurality of padlocks 25 are used to lock a single switch-lock attachment 22, which includes an insert 20, to a single circuit breaker 24 via a padlock accessory. Using a plurality of padlocks 25 in the locking of a single circuit breaker 24 can be useful for safety reasons. For example, when a number of operators may be simultaneously performing maintenance operations on a circuit that is controlled by the circuit breaker 24, it is desirable to ensure that that the circuit breaker 24 remains locked in the OFF position until all the operators finish their particular duties. When the operators finish their respective duties, each operator unlocks a respective one of the plurality of padlocks 25 that is assigned to that particular operator. Thus, if the duties of an operator take a longer period of time, that operator does not have to worry about being electrocuted as a result of the circuit breaker 24 being switched ON while he or she is working on the circuit. Having the insert 20 improves protection against twisting forces acting on the switch-lock attachment 22, which can cause the dislodgment of the switch-lock attachment 22 from the circuit breaker 24, that are caused by the combined weight of the plurality of padlocks 25.

Figure 9:
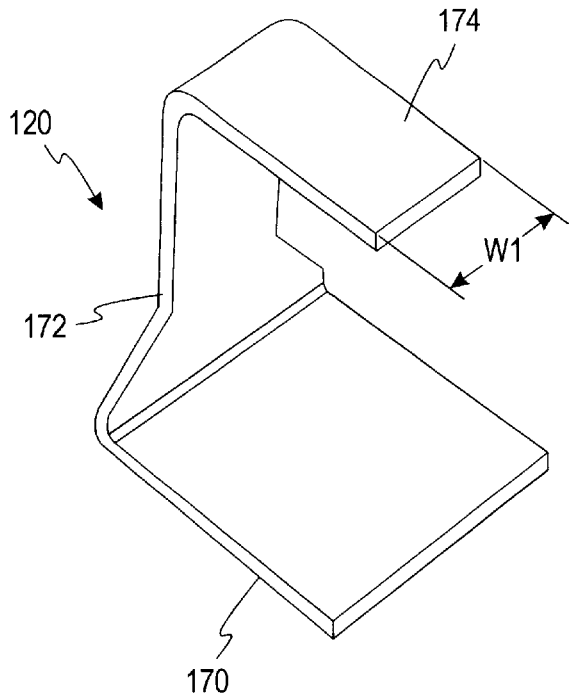
FIG. 9 is a perspective view of another embodiment of the insert of FIG. 3*a*.
Figure 10:
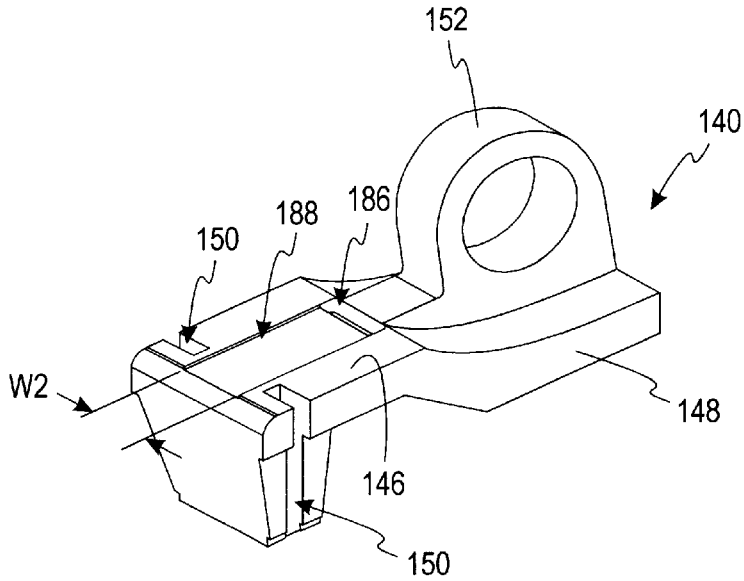
FIG. 10 is a perspective view of another embodiment of the support part of the switch-lock attachment shown in FIG. 2.

Referring now to FIGS. 9 and 10, another embodiment of the present invention will be described. In this embodiment, an insert 120 has an interface area 172 that is smaller than in the previous embodiment, which is shown in FIGS. 3*a*–3*b*. A support member 140 includes a slotted hole 186 and an interface slot 188. The slotted hole 186 is located between a flat mating surface 146 and a curved mating surface 148, and it protrudes through the entire thickness of the support member 140. The interface slot 188 is located on the flat mating surface 146, next to the slotted hole 186, and it has a depth which is generally equal to the thickness T of the insert 120. The interface area 172 is adapted to match the interface slot 188. Furthermore, the interface area 172 is adapted to prevent interference between the insert 120 and the spring member 44 (not shown). More specifically, the interface area 172 is narrow enough such that each one of a pair of legs 166 of the spring member 44 will freely engage the support member 140 and a locking member 142. A supporting end 174 is adapted to allow its insertion through the slotted hole 186. In other words, a width W1 of the supporting end 174 should be smaller than a width W2 of the slotted hole 186.

When connecting the insert 120 with the switch-lock attachment 22, the supporting end 174 is inserted through the slotted hole 186 and the interface area 172 is placed in contact with the interface slot 188. In this embodiment, the relative motion between the insert 120 and the switch-lock attachment 22 is prevented mostly by the connection formed between the interface area 172 and the interface slot 188.

The rest of the assembly of the switch-lock attachment 22 and the insert 120 to the circuit breaker 24 is similar to the previous embodiment described in reference to FIGS. 2–8.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A switch-lock assembly for securing a circuit breaker in one of a plurality of circuit breaker positions, comprising:

a switch-lock attachment having a spring member, a support member, and a locking member, the spring member being engageable to a retaining area of the circuit breaker, the support member being able to accommodate the spring member, the locking member being connected with the support member via the spring member, and an insert having a securing end and an interface area, the securing end being engageable to a first area of the circuit breaker for limiting movement of the insert relative to the circuit breaker, the interface area being engageable to the switch-lock attachment for limiting movement of the switch-lock attachment relative to the insert.

2. The switch-lock assembly of claim 1, wherein the insert further includes a supporting end for contacting a second area of the circuit breaker, the supporting end limiting movement of the switch-lock attachment when exposed to a compressive force.

3. The switch-lock assembly of claim 2, wherein the second area of the circuit breaker is a generally flat surface.

4. The switch-lock assembly of claim 1, wherein the interface area of the insert includes an opening adapted to allow visual observation of any one of the plurality of circuit breaker positions.

5. The switch-lock assembly of claim 1, wherein the support member includes a ring, and the interface area of the insert includes an aperture that is adapted to allow insertion of the ring through the insert.

6. The switch-lock assembly of claim 1, wherein the interface area of the insert includes two notches, the two notches allowing the spring member to be inserted through the insert and limiting rotational movement of the spring member.

7. The switch-lock assembly of claim 1, wherein the interface area of the insert includes two rectangular notches, the two rectangular notches allowing the spring member to be inserted through the insert and limiting rotational movement of the spring member.

8. The switch-lock assembly of claim 1, wherein the interface area is shaped to cause a separation between the support member and the locking member of the switch-lock attachment, the separation having generally the same dimension as the thickness of the insert.

9. The switch-lock assembly of claim 1, wherein the support member includes an interface slot for engaging part of the interface area of the insert, the interface slot limiting lateral movement of the switch-lock assembly relative to the insert.

10. The switch-lock assembly of claim 1, wherein the insert further includes a supporting end for contacting a second area of the circuit breaker, the supporting ends limiting movement of the switch-lock attachment when exposed to a pushing force, the support member includes a slotted hole for allowing the insertion of the supporting end through the slotted hole, the slotted holes limiting lateral movement of the switch-lock attachment relative to the insert.

11. The switch-lock assembly of claim 1, wherein the support member includes a slot for containing part of the interface area of the insert, the support member further including a slotted hole, the insert further having a supporting end for contacting a second area of the circuit breaker for limiting movement of the switch-lock attachment when exposed to a compressive force, the supporting end being inserted through the slotted hole.

12. The switch-lock assembly of claim 1, wherein the first area of the circuit breaker is a slot proximate a switch of the circuit breaker.

13. The switch-lock assembly of claim 1, wherein the retaining area of the circuit breaker is located proximate a switch of the circuit breaker, the retaining area including two holes for retaining the spring member.

14. A method for assembling a switch-lock assembly for use in a circuit breaker, comprising:

providing a switch-lock attachment having a spring member, a support member, and a locking member;

providing an insert having a securing end and an interface area;

positioning the insert between the support member and the locking member such that the switch-lock attachment is generally fixed relative to the insert;

connecting the locking member to the support member via the spring member;

sandwiching the insert in-between the locking member and the support member;

engaging the spring member to a retaining area of the circuit breaker; and engaging the securing end of the insert to a first area of the circuit breaker such that the insert is generally fixed relative to the circuit breaker.

15. The method of claim 14, further comprising locking the switch-lock attachment using a lock.

16. The method of claim 14, further comprising resting a supporting end of the insert on a second area of the circuit breaker for limiting the movement of the switch-lock attachment when exposed to a compressive force.

17. The method of claim 14, further comprising forming an opening in the interface area of the insert to allow visual observation of one of a plurality of circuit breaker positions.

18. The method of claim 14, further comprising inserting a loop end of the support member through an opening of the interface area for limiting lateral movement of the switch-lock attachment relative to the insert.

19. The method of claim 14, further comprising inserting the spring member through two notches of the interface area for limiting lateral movement of the spring member relative to the insert.

20. The method of claim 14, further comprising providing a slot in the support member for limiting lateral movement of the switch-lock attachment relative to the insert.

21. The method of claim 14, further comprising:

resting a supporting end of the insert on a second area of the circuit breaker for limiting movement of the switch-lock attachment when exposed to a pushing force; and inserting the supporting end through a slotted hole of the support member for limiting lateral movement of the switch-lock attachment relative to the insert.

22. The method of claim 14, further comprising:

providing a slot in the support member for limiting lateral movement of the switch-lock attachment relative to the insert;

forming a slotted hole in the support member;

providing a supporting end in the insert; and inserting the supporting end through the slotted hole and positioning the supporting end in contact with a second area of the circuit breaker for limiting movement of the switch-lock attachment when exposed to a compressive force.

23. An anti-twist insert for use with a switch-lock attachment of a circuit breaker, comprising:

a securing end being engageable to a first area of the circuit breaker, the securing end limiting lateral movement of the insert relative to the circuit breaker;

an interface area being engageable to the switch-lock attachment for increasing the force required to twist-off the switch-lock attachment, the interface area including a ring aperture for inserting a ring of the switch-lock attachment, an opening dimensioned to allow visual observation of a position of the circuit breaker, and a plurality of notches for constraining rotational movement of a spring member of the switch-lock attachment; and a supporting end for contacting a second area of the circuit breaker, the supporting end limiting movement of the switch-lock attachment when exposed to a compressive force.

24. An anti-twist insert for use with a switch-lock attachment of a circuit breaker, comprising:

a securing end being engageable to a first area of the circuit breaker for constraining rotational movement of the insert;

an interface area being engageable to the switch-lock attachment for increasing the force required to twist-off the switch-lock attachment, the interface area engaging an interface slot in a support member of the switch-lock attachment; and a supporting end for contacting a second area of the circuit breaker, the supporting ends limiting movement of the switch-lock attachment when exposed to a pushing force, the supporting end being inserted through a slotted hole of the support member of the switch-lock attachment.

25. A switch-lock assembly for securing a circuit breaker in one of a plurality of circuit breaker positions, comprising:

a circuit breaker including a switch for moving the circuit breaker between a plurality of circuit breaker positions, a slot, and a retaining area being positioned proximate the switch; and a switch-lock attachment for securing the switch of the circuit breaker in one of the plurality of circuit breaker positions, the switch-lock attachment including a spring member, a support member, and a locking member, the spring member being able to secure the support member and the locking member to the retaining area of the circuit breaker, the support member having a ring, the locking member being movable between a secured position and an open position of the switch-lock attachment;

the improvement including an anti-twist insert including a securing end being engageable to the slot of the circuit breaker for limiting lateral movement of the insert, and an interface area positioned in-between the support member and the locking member of the switch-lock attachment for limiting lateral movement of the switch-lock attachment relative to the insert, the interface area being able to cause a separation between the support member and the locking member, the separation being generally the same dimension as the thickness of the insert.

26. A switch-lock assembly for securing a circuit breaker in one of a plurality of circuit breaker positions, comprising:

a circuit breaker including a switch for moving the circuit breaker between a plurality of circuit breaker positions, a slot, a retaining area positioned proximate the switch, and a resting area; and a switch-lock attachment for securing the switch of the circuit breaker in one of the plurality of circuit breaker positions, the switch-lock attachment including a spring member, a support member, and a locking member, the spring member being able to secure the support member and the locking member to the retaining area of the circuit breaker, the support member having a ring, the locking member being movable between a secured position and an open position of the switch-lock attachment; and the improvement including an anti-twist insert including a securing end being engageable to the slot of the circuit breaker for limiting lateral movement of the insert, an interface area positioned in-between the support member and the locking member of the switch-lock attachment for limiting lateral movement of the switch-lock attachment relative to the insert, the interface area being able to cause the support member and the locking member to be separated by a distance that is generally equal to the thickness of the insert, the interface area including a notch for allowing the visual observation of any one of the plurality of positions of the circuit breaker, and a supporting end for contacting the resting area of the circuit breaker, the supporting end limiting movement of the switch-lock attachment when exposed to a compressive force.

27. A switch-lock assembly for securing a circuit breaker in one of a plurality of circuit breaker positions, comprising:

a circuit breaker including a switch for moving the circuit breaker between a plurality of circuit breaker positions, a securing slot, a retaining area being positioned proximate the switch, and a resting area; and a switch-lock attachment for securing the switch of the circuit breaker in one of the plurality of circuit breaker positions, the switch-lock attachment including a spring member, a support member, and a locking member, the spring member being able to secure the support member and the locking member to the retaining area of the circuit breaker, the support member having an insert slot, a slotted aperture, and a ring, the locking member being movable between a secured position and an open position of the switch-lock attachment;

the improvement including an anti-twist insert including a securing end being engageable to the securing slot of the circuit breaker for limiting lateral movement of the insert, an interface area positioned in-between the support member and the locking member of the switch-lock attachment for limiting lateral movement of the switch-lock attachment relative to the insert, the interface area being able to cause the support member and the locking member to be separated by a distance that is generally equal to the thickness of the insert, the interface area being placed in contact with the insert slot, and a supporting end for contacting the resting area of the circuit breaker, the supporting end limiting movement of the switch-lock attachment when exposed to a compressive force, the supporting end being inserted through the slotted aperture of the support member.

28. A method for using a switch-lock assembly to secure a circuit breaker in one of a plurality of circuit breaker positions, comprising:

providing a circuit breaker having a switch for moving the circuit breaker between a plurality of circuit breaker positions, a slot, and a retaining area being positioned proximate the switch;

providing a switch-lock attachment for securing the switch of the circuit breaker in one of the plurality of circuit breaker positions, the switch-lock attachment including a spring member, a support member having a ring, and a locking member;

providing an anti-twist insert having a securing end, an interface area, and a thickness;

positioning the insert between the support member and the locking member of the switch-lock attachment such that movement of the switch-lock attachment is limited relative to the insert and such that the separation between the support member and the locking member is generally equal to the thickness of the insert;

connecting the spring member to the retaining area of the circuit breaker;

positioning the securing end of the anti-twist insert in the slot of the circuit breaker;

urging the locking member of the switch-lock attachment from an open position toward a secured position; and locking the support member to the circuit breaker via the ring.

* * * * *